US006186569B1

(12) United States Patent
Heid

(10) Patent No.: US 6,186,569 B1
(45) Date of Patent: Feb. 13, 2001

(54) HEATER SLING

(75) Inventor: Gary R. Heid, Vancouver, WA (US)

(73) Assignee: SEH America, Inc., Vancouver, WA (US)

( * ) Notice: Under 35 U.S.C. 154(b), the term of this patent shall be extended for 0 days.

(21) Appl. No.: 09/448,716

(22) Filed: Nov. 24, 1999

(51) Int. Cl.[7] ..... B66C 1/54; B25B 27/14
(52) U.S. Cl. ..... 294/95; 294/115
(58) Field of Search ..... 294/94, 95, 97, 294/89, 86.24, 86.25, 115

(56) References Cited

U.S. PATENT DOCUMENTS 995,662 * 6/1911 Commetti ..... 294/86.24
2,336,527 * 12/1943 Bullington ..... 294/115
2,951,725 * 9/1960 Jean ..... 294/97
3,442,546 * 5/1969 Bachman ..... 294/95
3,574,381 * 4/1971 Ocheltree ..... 294/94
4,083,593 * 4/1978 Lynn ..... 294/97
4,583,275 * 4/1986 Diaz ..... 294/95

FOREIGN PATENT DOCUMENTS

614299 * 9/1926 (FR) ..... 294/115

* cited by examiner

*Primary Examiner*—Dean J Kramer
*Assistant Examiner*—Paul T. Chin
(74) *Attorney, Agent, or Firm*—Douglas G. Anderson; Timothy H. Courson

(57) ABSTRACT

The heater sling according to this invention is capable of lifting, moving and positioning a workpiece. In particular, it relates to a device and method for lifting a circumferential heater used in the manufacture of silicon ingots by the Czochralski method. The invention operates by mechanically extending a plurality of slings under a workpiece, lifting the workpiece, and placing it in a desired location.

5 Claims, 4 Drawing Sheets

HEATER SLING

BACKGROUND OF THE INVENTION

1. Field of the Invention

The present invention relates to an apparatus and method for lifting, moving and positioning a workpiece. In particular, it relates to a device and method for lifting a circumferential heater used in the manufacture of silicon ingots by the Czochralski method.

2. Description of the Prior Art

Traditionally, devices used to lift circumferential heaters used in the manufacture of silicon ingots are lowered around the outside edge of the heater. Slider bars are then inserted under the heater, and secured to the lifter. In some instances, a cage is then placed around the heater. Prior devices required an operator to manually place support plates under the heater, attach a cage to the supports, and then attach this apparatus to a lifting device. The heater could then be lifted from the bottom chamber of a Czochralski-type crystal puller machine for machine cleaning or heater replacement. These same devices are also used to place a new heater in the puller machine.

The above device, and similar devices, are appropriate for silicon manufacturing operations. However, they have a number of parts that must be assembled prior to and during the lifting, thereby consuming operator and machine time. This assembly and disassembly results in metal-to-metal contact among the device's parts, within the assembly, potentially damaging the device. Additionally, heat transfer from the heater the lifter, resulting from contact between the heater and the lifter, can cause the lifter to warp, leading to the added cost and time of replacement parts; it also increases the temperature of the lifter, thereby requiring a cooling period before the lifter can be handled.

SUMMARY OF THE INVENTION

In view of the above problems, an object of the present invention is to provide an apparatus and method for lifting and positioning a device, such as a circumferential heater, with reduced operator "hands-on" activity. The present device can be lowered into the center of a circumferential heater, the sling foot pads positioned under the heater, and the heater and lifter combination lifted by a single operator, using a remote control box. The present invention improves on past devices due to an operator's ability to operate it from a distance, reduced metal-to-metal contact, and ease of use.

The present invention also has relatively few parts. This reduces the amount of time an operator must spend setting up and taking down the apparatus, thereby enabling a more efficient process. Additionally, the present invention is, essentially, a one-piece construction after assembly. This helps to control warpage and commensurate part misfits.

Another improvement over the prior art is the present invention's elimination of an exterior cage. As opposed to prior heater-lifting devices, which enclosed the heater within a cage or similar means, the present invention lifts a circumferential heater from within its center void. This interior placement eliminates the need for an exterior cage, thereby reducing operator time, warpage, and heat transfer, as described above.

The present invention also reduces metal-to-metal contact by using polymer-based, ceramic, graphite, carbon composite or equivalent bushings and pads. These pads protect both the lifter and the heater from damage, and keep the lifter cooler than the previous lifter devices. The pads have the additional benefit of not contributing metal contamination to the Czochralski process.

BRIEF DESCRIPTION OF THE DRAWINGS

The present invention is described by reference to the examples and the drawings, in which.

DETAILED DESCRIPTION OF THE INVENTION

Figure 1:
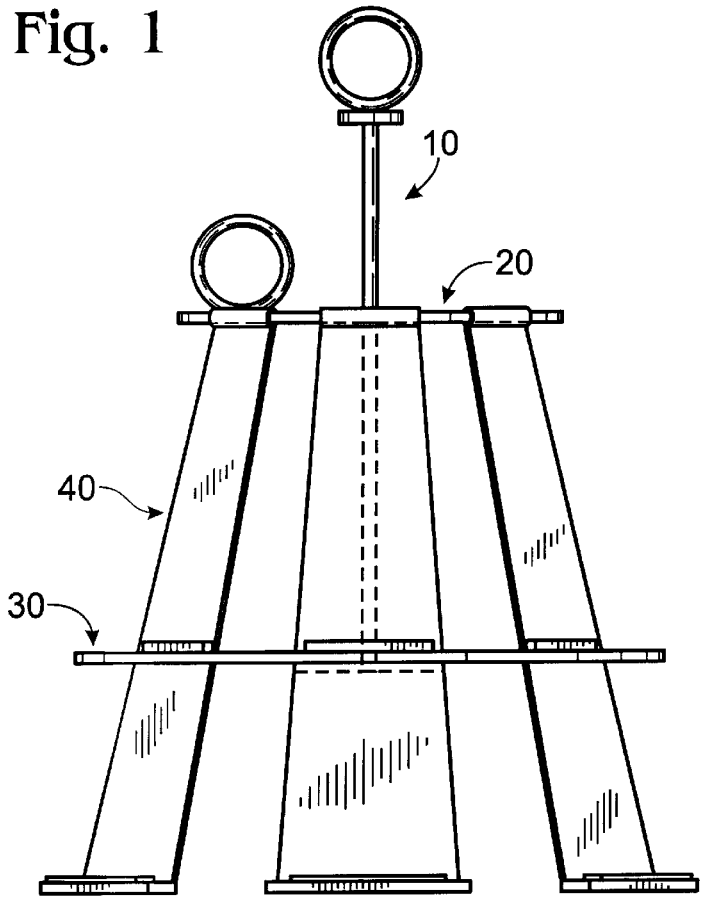
FIG. 1 is a side view of a preferred embodiment of the present invention, with slings extended and support rod in the up position.
Figure 2:
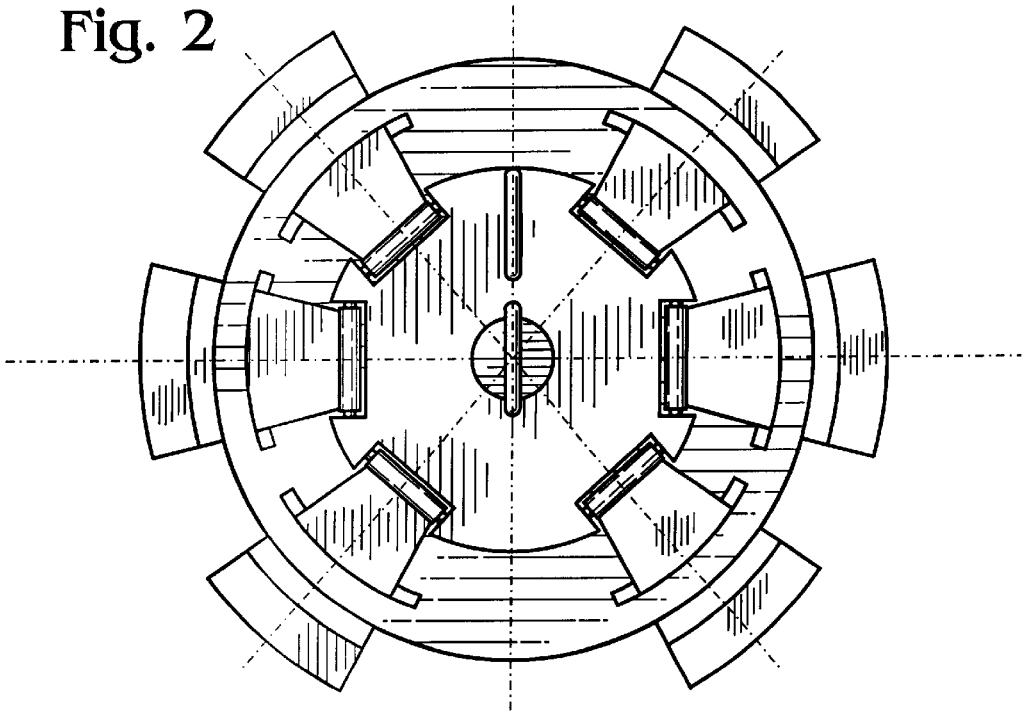
FIG. 2 is a top view of a preferred embodiment of the present invention.

As delineated in the drawings, and shown in FIG. 1, the present invention comprises a support rod 10, a top support 20, a bottom support 30, and a plurality of slings 40.

Figure 3:
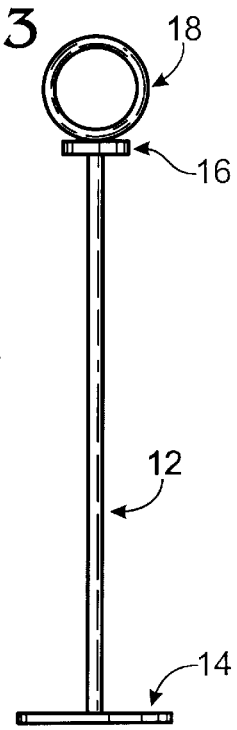
FIG. 3 is a side view of the support rod.

As shown in FIG. 3, a support rod 10 comprises a support rod shaft 12, a bottom pad 14 removably attached to a distal end of the shaft 12, a top pad 16 removably attached to the end of the shaft 12 opposite the bottom pad 14, and a hoist mechanism 18 attached to the surface of the top pad 16 opposite the shaft 12.

Figure 4:
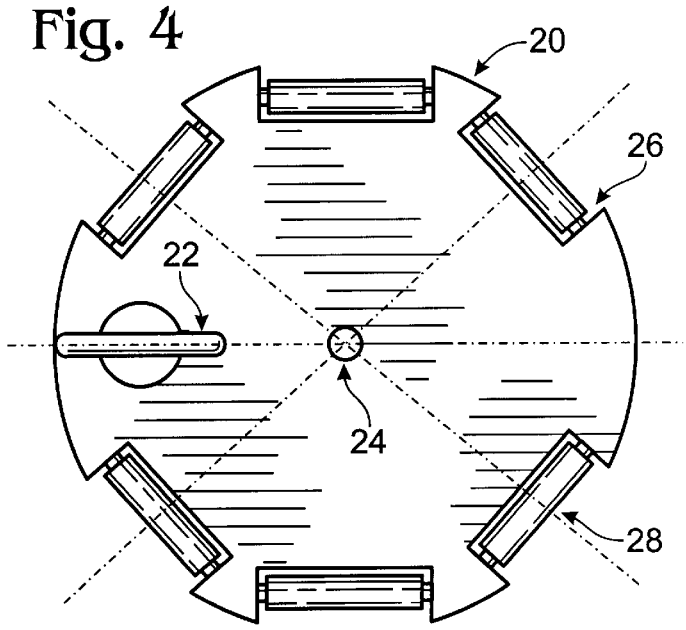
FIG. 4 is a top view of the top support.

The top support 20, as shown in FIG. 4, comprises a hoist mechanism 22 attached to the top surface of the top support 20, a center void 24 running vertically through the center of the top support 20, and a plurality of removably attached pivot shafts 26. In a preferred embodiment, the pivot shafts 26 as shown in FIG. 4 are seated in three-sided notches 28 spaced about the outer edge of the top support 20. The shafts 26 and notches 28 are distributed reasonably equally about the circumference of the top support 20, and are sized such that a sling 40 fits into a notch 28. The notch 28 is wide and deep enough so that the sling 40 can swing freely, but narrow enough so that the sling 40 has limited horizontal play within the notch 28.

Figure 5:
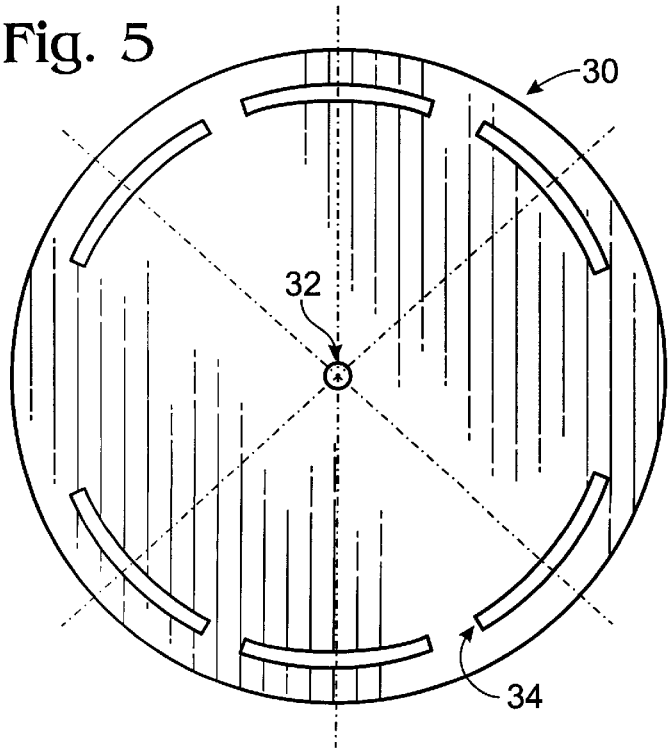
FIG. 5 is a top view of the bottom support.

The bottom support 30, shown in FIG. 5, comprises a center void 32 and a plurality of circumferential slots 34. The slots 34 are arranged substantially similar to the upper support pivot shafts 26 and notches 28, but are located a greater distance from the bottom support center void 32 than the pivot shafts 26 are from the top support center void 24.

Figure 6:
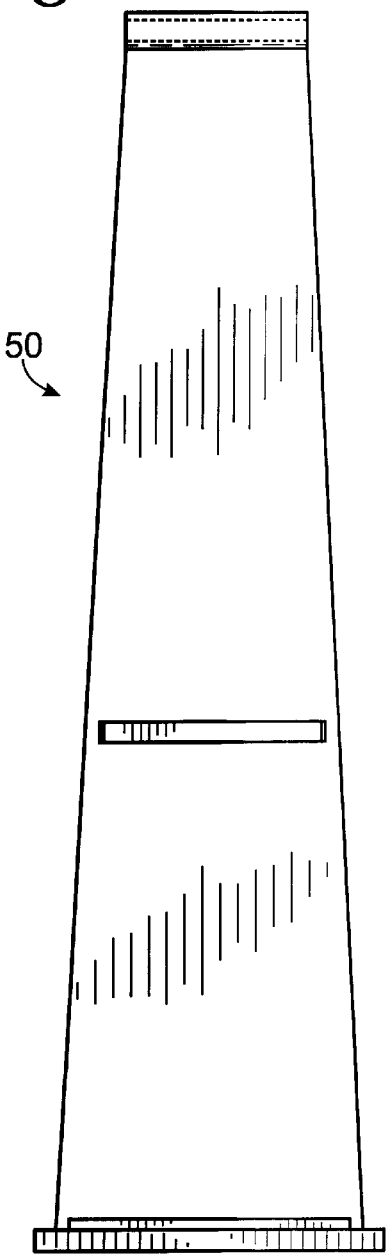
FIG. 6 is a front side view of an outer sling.
Figure 7:
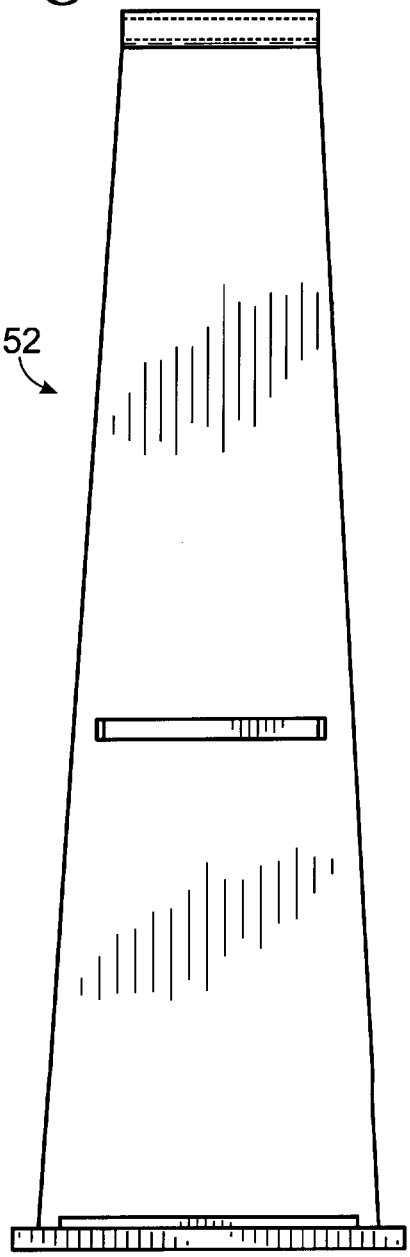
FIG. 7 is a front side view of a middle sling.
Figure 8:
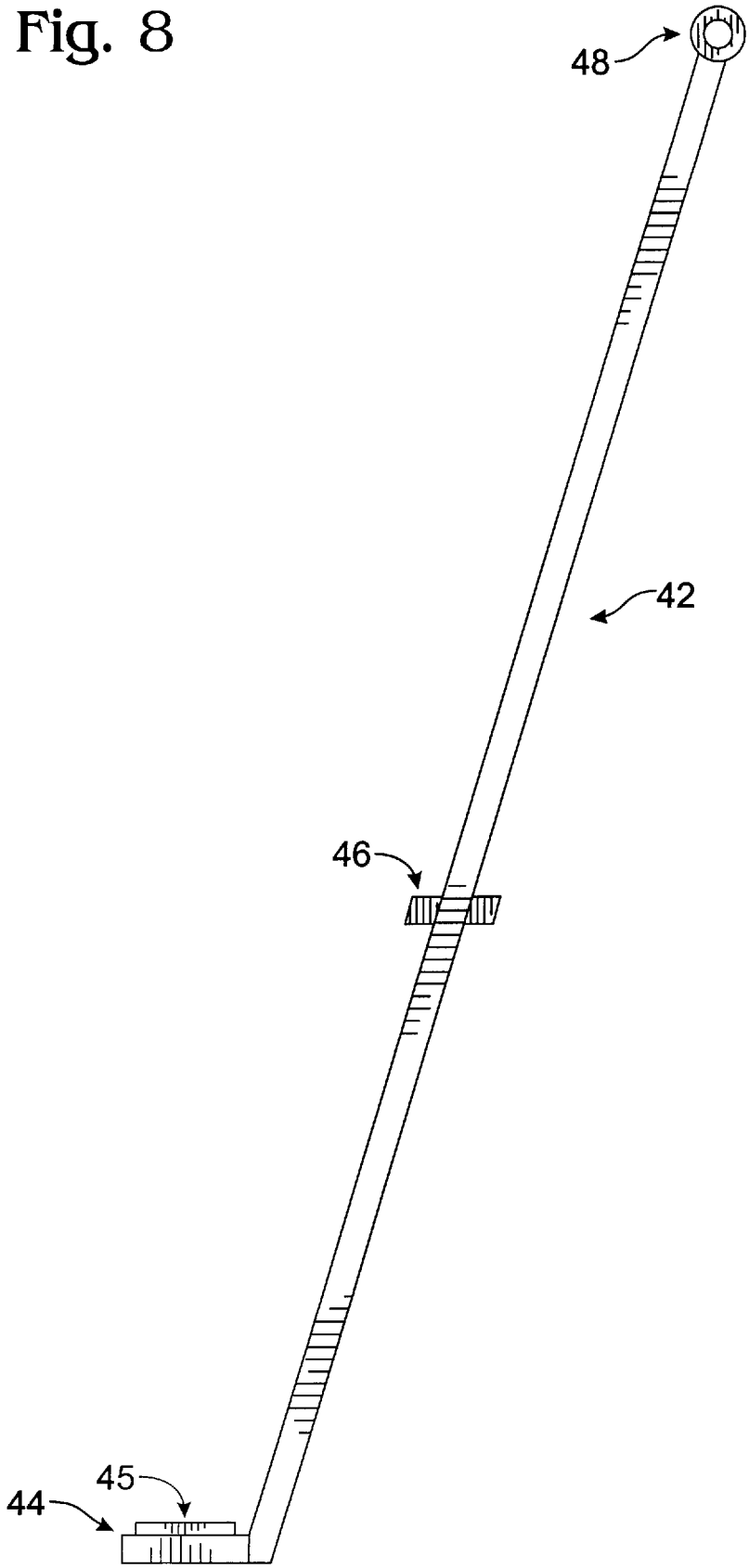
FIG. 8 is a side view of a representative sling.

A representative sling 40 is shown in FIG. 1. The sling 40 has a rigid body 42 and foot plate 44 as shown in FIG. 8. Fixed stoppers 46 are located approximately medially on the rigid body 42 of the slings. A cylindrical void 48 at one end of the rigid body 42 attaches to the top support pivot shafts 26. The foot plate 44 attaches to the other end of the rigid body 42. In a preferred embodiment of the invention, the slings comprise middle slings 50 (FIG. 7) and outer slings 52 (FIG. 6). In such an embodiment, the middle slings 50 are wider than the outer slings 52. The differing widths are necessary in this embodiment because of the configuration of the workpiece supports. If required, all of the slings could be of varying or equal widths, depending on the workpiece.

As shown in FIGS. 1, 4, and 5, the invention is configured such that the support rod shaft 12 runs through both the top support center void 24 and the bottom support center void 32. The bottom pad 14 is disposed below the bottom support 30 such that when the invention is in a substantially upright position, the bottom support 30 is supported by the bottom pad 14. The support rod top pad 16 is disposed above the top support 20 such that the top support 20 is at all times between the top pad 16 and the bottom support 30.

In a preferred embodiment of the invention, though it would not be so limited, a washer (not shown), composed of a polymer-based, heat-resistant material such as Teflon®, covers the inside surface of the top and bottom support center voids 24 and 32 so as to minimize metal-to-metal contact between the support rod 10 and the top support 20 and bottom support 30.

The slings 40 are swingably connected by pivot shafts 26 to the top support 20 such that the cylindrical void 48 of the slings 40 fits into the notches 28 of the top support 20. In a particular embodiment of the invention, though it would not be so limited, a bushing (not shown), composed of a polymer-based, heat-resistant material such as Teflon®, or another non-metallic, heat resistant material such as a ceramic, is utilized in combination with the pivot shaft 26 such that minimal metal-to-metal contact occurs between the sling 40 and the top plate 20.

In a preferred embodiment, a polymer-based, heat-resistant material such as Teflon® can be used to form pads 45. The pads 45 are fixably attached to the upper surface of the foot plate 44 of the sling 40. In addition to a polymer-based material, other heat-resistant, non-metallic materials, such as ceramic, could be utilized in the bushings, washers, pads, and other heat protective elements included in the invention.

The slings 40 pass through the slots 34 of the bottom support 30. The bottom support 30 has a range of motion slidably along the slings with upper and lower limits at the medially positioned stoppers 46 and the sling foot plate 44. In a preferred embodiment of the invention, though it would not be so limited, the interior of the slots 34 are lined with a polymer-based, heat-resistant material such as Teflon® or equivalent. The heat resistant material would extend outwardly along the upper and lower surface of the bottom support 30 such that when in the open position there is minimal metal-to-metal contact between the bottom support 30 and the sling stoppers 46.

In a preferred method, the apparatus would be used to raise, lower, and position a circumferential heater into the lower portion of a Czochralski-type puller machine utilized in the semiconductor industry. One skilled in the art, however, could utilize both the apparatus and the method in any situation where the workpiece has an interior void suitable for insertion of a circumferential lifter as disclosed herein.

In a preferred method, beginning with the step where the apparatus is outside the heater, and the heater is to be lifted out of the puller machine for cleaning, replacement, or other suitable reason, an operator attaches a support line or similar device to the top support hoist mechanism 22. The support line could be secured to the hoist mechanism by means of a hook, or quick release securing device or equivalent. The operator then raises the apparatus, and lowers the apparatus into the pulling machine such that the apparatus is positioned in the interior of the circumferential heater. The operator then repositions the support line from the top support hoist mechanism 22 to the support rod hoist mechanism 18. The operator then places tension on the support line, thereby causing the support rod 10 to rise. The rising support rod causes the slings 40 to extend outward and under the circumferential heater. The heater-lifter combination is then ready for lifting or repositioning. The operator can then raise the heater-lifter combination out of the puller machine, and position it on the shop floor or other desired location. After the heater-lifter combination is placed at the desired position, the support line is slacked, causing the support rod 10 to lower. The lowering support rod causes the slings 40 to retract, thereby disengaging the heater from the lifter. The lifter can then be extracted from the interior of the heater by repositioning the support line from the support rod hoist mechanism 18 to the top support hoist mechanism 22, and lifting the lifter.

What is claimed is:

1. A lifting apparatus comprising:

(a) a top support, said top support having a top surface and a bottom surface that lay in a substantially horizontal fashion and a diameter, said top support including a void running vertically through the center of said top support, said void having sufficient diameter to accommodate a support rod's shaft, a plurality of removable attached pivot shafts spaced along the outside circumferential edge of said top support, and a hoist mechanism attached to said the top surface of said top support;

(b) a bottom support, said bottom support having a top surface and a bottom surface that lay in a substantially horizontal fashion and a diameter greater than said diameter of the top support, said bottom support including a void having sufficient diameter to accommodate a support rod's shaft running vertically through the center of said bottom support, and a plurality of slots, said slots located a distance from the center of the support that is greater than the distance from the center of said top support to said pivot shafts of said top support;

(c) a support rod, said rod having a shaft running through the voids of said top support and said bottom support, a bottom pad removably attached perpendicularly to one end of said shaft and located below the bottom surface of said bottom support, and a top pad removably attached perpendicularly to the other end of said shaft wherein said top pad has a hoist mechanism attached to the surface opposite where said shaft is attached and where said top pad is located above the top surface of said top support, wherein each pad constrains said top and bottom supports to slide along said support rod; and (d) a plurality of slings, each of said slings having a rigid body running through the slots of said bottom support, a cylindrical void at one end of said rigid body that attaches to the pivot shafts of said top support, a foot plate removably attached on the opposite end of said rigid body and at an oblique angle to said rigid body such that the foot plate is substantially horizontal, and a stopper removably attached to said rigid body between the foot plate and the cylindrical void and assembled between the bottom surface of said top support and the top surface of said bottom support such that the sling can slide through the slots on said bottom support from the foot plate of said sling to the stopper on the rigid body of said sling.

2. The lifting apparatus of claim 1 further comprising:

(a) heat resistant bushings, said bushings disposed between:

(i) said top support and said plurality of slings at the top support—sling interface;

(ii) said support rod shaft and said top support at the interface of said support rod shaft and said top support center void;

(iii) said support rod shaft and said bottom support at the interface of said support rod shaft and said bottom support center void; and (iv) said plurality of slings and said bottom support slots, at the interface of said plurality of slings and said bottom support slots.

3. The lifting apparatus of claim 1 further comprising:

(a) heat resistant pads positioned on said foot plate of said slings, said pads fixably attached to a face of said lower portion of said sling which substantially faces said bottom support.

4. A method for positioning a workpiece utilizing the apparatus as described in claim 1 comprising:

(a) placing a lifting apparatus in position;

(b) imparting an upward force upon said support rod hoist mechanism such that said slings extend outwardly and under said workpiece;

(c) lifting said apparatus and said workpiece;

(d) placing said apparatus and said workpiece at a desired location;

(e) lowering said support rod such that said slings retract inwardly;

(f) imparting an upward force upon said top support hoist mechanism; and (g) withdrawing said lifting apparatus from said workpiece.

5. The method of claim 4 wherein the workpiece is a circumferential heater used in the manufacture of silicon ingots.

* * * * *